United States Patent [19]

Isikawa

[11] Patent Number: 4,557,522

[45] Date of Patent: Dec. 10, 1985

[54] VEHICLE SEAT

[75] Inventor: Yasuo Isikawa, Akishima, Japan

[73] Assignee: Tachikawa Spring Co., Ltd., Japan

[21] Appl. No.: 558,530

[22] Filed: Dec. 6, 1983

[51] Int. Cl.[4] ..... A47C 7/02

[52] U.S. Cl. ..... 297/452; 297/218; 297/219; 297/DIG. 1

[58] Field of Search ..... 297/219, 218, DIG. 1, 297/459, 452; 29/407

[56] References Cited

U.S. PATENT DOCUMENTS

| | | | |
|---|---|---|---|
| 2,959,848 | 11/1960 | Savitt | 29/407 |
| 3,201,859 | 8/1965 | Stanley | 29/407 X |
| 3,216,101 | 11/1965 | Miller | 29/407 |
| 3,284,889 | 11/1966 | Prazak, III | 29/407 |
| 3,630,572 | 12/1971 | Homier | 297/218 |
| 4,332,419 | 1/1982 | Vogel | 297/452 |
| 4,432,521 | 2/1984 | Douglas | 297/218 |

*Primary Examiner*—James T. McCall

*Attorney, Agent, or Firm*—Cushman, Darby & Cushman

[57] ABSTRACT

A seat used for vehicles such as an automobile and airplane. This seat comprises a cushion member provided on its surface with one or more markings for positioning of a top member and a top member to cover the cushion member provided with a matching part corresponding to the marking. The cushion member may be formed of a foam material, and the surface of the cushion member may be flat or concavo-convex. The marking may be formed by cutting out the surface of the cushion member or by coloring the same with a coloring agent.

4 Claims, 5 Drawing Figures

VEHICLE SEAT

BACKGROUND OF THE INVENTION

1. Field of the Invention

The present invention relates to a seat for a vehicle (for example, an automobile), and more particularly to an improved vehicle seat constructed by covering a cushion member formed of foaming materials, such as urethane foam, with a top layer member.

2. Description of the Prior Art

In the conventional seat of this type, it has been rather difficult to place a top layer member over a cushion member correctly at a predetermined position thereof. That is, the top member has often been bent or tends to slip out of place. In a seat of such a type as provided with line patterns on the surface of the top member thereof for a finer aesthetic appearance, inter alia, since the line patterns are deformed, the aesthetic appearance of the seat is impaired and thus the commercial value of the same is lowered accordingly. Therefore, in order to avoid such inconveniences, it takes much time and labor to cover the cushion member with the top member. In other words, the efficiency of such covering (placing) operation is degraded correspondingly.

SUMMARY OF THE INVENTION

In view of the above-mentioned drawbacks in the prior art seat, it is a main object of this invention to provide a vehicle seat which can be constructed by means of rapid and accurate placing operation of a top member over a cushion member with no skill required.

In order to achieve the above object, according to the invention, there is provided on the cushion member a marking for positioning of the top member and there is also provided in the top member a matching part which corresponds to the marking. Therefore, when placing the top member on the cushion member, by matching the matching part of the top member with the marking on the cushion member, it is possible to correctly place the top member over the cushion member at a predetermined position thereof so as to provide a vehicle seat having a fine aesthetic appearance.

The cushion member is formed of a foaming material by molding.

The marking provided in the cushion member for positioning of the top member comprises a recessed portion formed at a convenient position in the cushion member, and there is provided in the top member the matching part to be fitted into this recessed portion in the cushion member. Therefore, when the top member is placed over the cushion member with the matching part thereof fitted into the recessed portion in the cushion member, it is ensured that the top member is fixed to the cushion member at a predetermined position in the latter and thus, the top member will not slip out of place after it is assembled to the seat.

The marking to be provided in the cushion member may also comprise any patterns colored, such as dots, lines and the like.

The top member is formed by sewing together a number of cloth pieces so that it can be placed closely on the surface of the cushion member which has a concavo-convex configuration. Accordingly, by providing the marking on the surface of the cushion member as well as by placing the top member over the cushion member such that the matching part of the top member coincides with the marking on the cushion member surface, it is ensured that said number of cloth pieces forming the top member can be located at their respective, predetermined positions in the cushion member.

The above-mentioned object as well as other objects, features and advantages of the present invention will be more apparent to those who are skilled in the art by reading the following detailed description with reference to the accompanying drawings. In the drawings, which illustrate typical embodiments of this invention, the same reference numerals represent the same or corresponding portions throughout the drawings,.

DETAILED DESCRIPTION OF THE PREFERRED EMBODIMENTS OF THE PRESENT INVENTION

Figure 1:
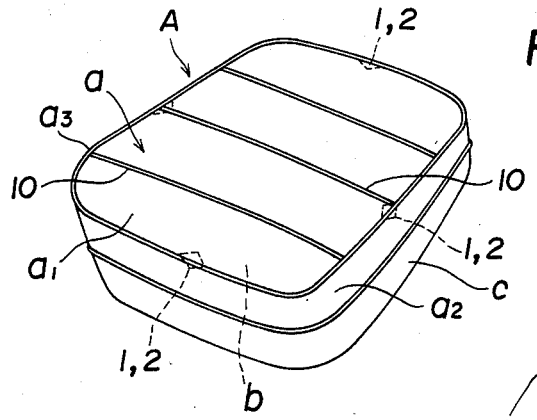
FIG. 1 is a perspective view, illustrating a first embodiment of the invention.
Figure 2:
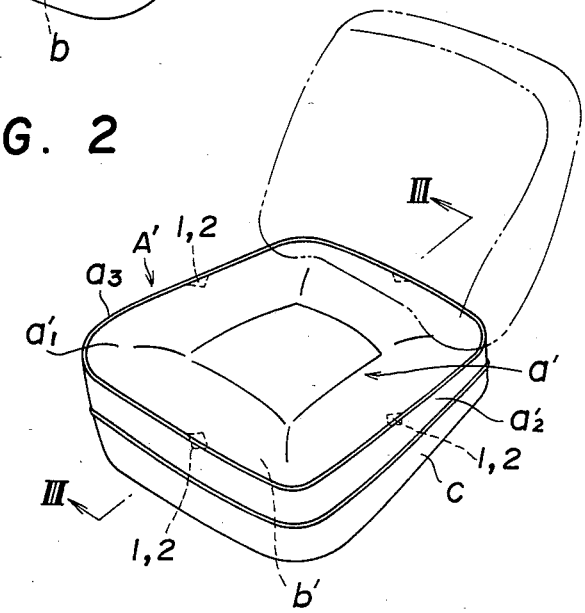
FIG. 2 is a perspective view of a second embodiment of the invention.

FIG. 1 illustrates a seat (A) comprising a top member (a) provided with a plurality of line patterns (10) for decoration and a cushion member (b) having a substantially flat-shaped upper surface.

In FIG. 2–5, there is shown a seat (A') which employs a cushion member (b') provided with a recesses portion (20) on its surface.

In the drawings, (c) designates a saucer-shaped hard frame (formed of a metal plate or hard synthetic resin plate), to which frame are fixedly secured said cushion members (b),(b') by adhesion or other suitable means.

Figure 3:
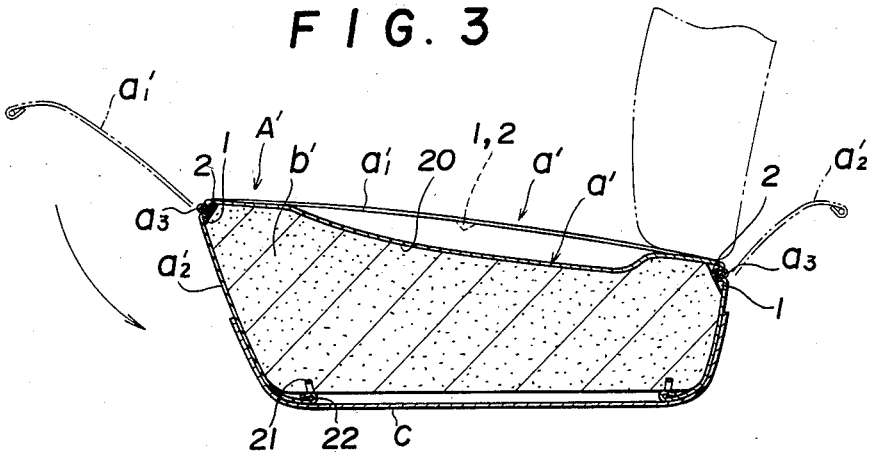
FIG. 3 is a longitudinal sectional view taken along a line III—III in FIG. 2.
Figure 4:
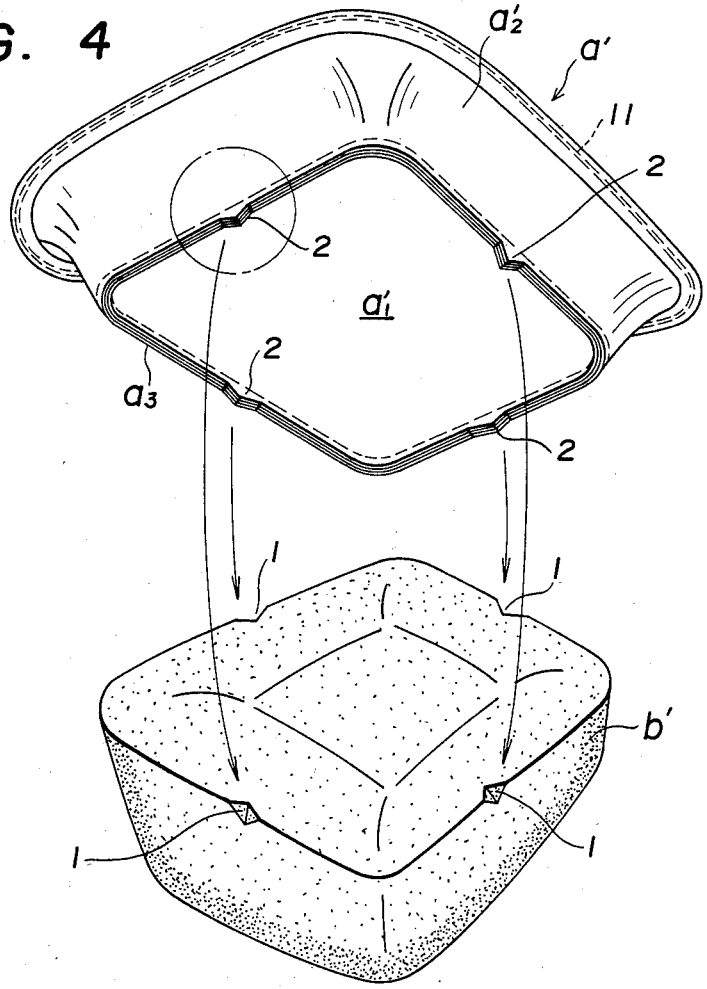
FIG. 4 is an exploded, perspective view of the second embodiment shown in FIG. 2; and, FIG. 5 is a partially enlarged, perspective view of a top member employed in the second embodiment.
Figure 5:
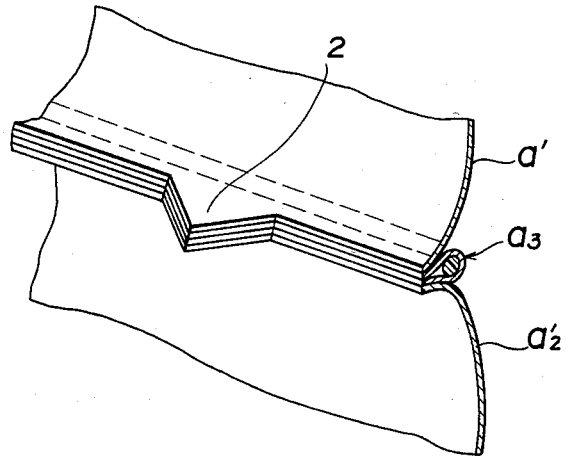

The top members, denoted by (a),(a') in the drawings, are placed in a manner similar to the prior art. In other words, the placement of the top members (a),(a') is achieved in the following way: first the ends of the top members (a),(a') are sewn to form a bag-like shape, a wire (11) is then inserted through the bag (FIG. 4), and the end of the wire is connected with a lower frame line (21) embedded in the cushion members (b),(b') by means of a hogged ring (22) or other suitable means, as shown in FIG. 3. If the cushion member (b') has a concavo-convex configuration on its surface, then the top member (a) must be formed by sewing together a number of cloth pieces so as to adhere closely to the concavo-convex surface of the cushion member.

Also, the illustrated top members (a),(a') are formed by sewing together their respective body portions (a1), (a1') and gore portions (a2),(a2') by means of respective hem portions (a3) such that the respective sewn portions are positioned along the respective upper peripheries of the cushion members (b),(b'). These top members (a),(a') are conventionally well known members; for example, they may be a single top member formed of a synthetic resin sheet for a textile fabric, or they may be formed by piling up together three members, that is, a top member, a wadding (of a foam material) and a wadding cover, and then sewing or welding them together to form an integral unit. The top member shown in FIG. 1 is constructed by providing on its surface a plurality of transversely extending, line-shaped patterns (10),(10) for decoration in a recessed form (by welding) or by sewing said line patterns to the surface thereof.

Cushion members, denoted by (b),(b') in the drawings, are products formed of urethane foam or the like by molding. The cushion members are provided with markings (1),(1) for positioning of the top members, which are simultaneously produced during formation in the form of recesses at suitable positions such as their upper peripheries on their surfaces, respectively. Such marking, however, may also be formed by coloring dotted lines after the molding formation, instead of producing it in the recessed form.

Reference numeral (2) in the drawings represents a matching portion or part provided in the top member (a) and corresponding to the above marking (1). Specifically, the matching part illustrated projects the sewn portion of the body portions (a1),(a1'), gore portions (a2),(a2') and hem portions (a3) so that it can be fitted into the notched portion of said marking (1).

Since the marking (1) and matching part (2) are thus provided to be engaged with each other, the lateral slippage of the top members (a),(a') can be prevented after the cushion member (b) is closed up.

Although not shown, the matching part (a), of course, can also be formed by simply coloring dots in a similar manner to the above mentioned marking (1).

Accordingly, the top members (a),(a') mentioned above are placed on the associated cushion members (b),(b') such that the matching parts (2) thereof coincide with the markings (1) of the cushion members so as to form seats (A),(A').

According to the invention, as described hereinbefore, since the top member can be placed up with its matching part (a) fitted into the marking (1) in the cushion member, a desired placement of the top member can be obtained without causing the top member bent or to be slipped out of place. Consequently, the present invention can provide a seat of uniform quality and a very high efficiency in the placement operation with no special skill required.

What is claimed is:

1. A vehicle seat comprising:

a cushion member having an upper surface and opposing pairs of side surfaces, said opposing pairs of side surfaces defining an upper peripheral edge together with said upper surface;

a cover member covering said upper surface and said opposing pairs of side surfaces of said cushion member, said cover member including a top portion for covering said upper surface and gore portions for covering said opposing pairs of side surfaces, said top and gore portions being united with one another along a seam portion in registry with said peripheral edge; and locating means for locating said seam portion in registry with said peripheral edge, said locating means including plural marking means spaced apart along said peripheral edge for marking the correct placement of said cover member relative said cushion member, and plural means defining locating portions, integrally associated with said seam portion at spaced positions, each said locating portion being in registry with a respective one of said marking means for superjacently positioning said seam relative said peripheral edge.

2. A vehicle seat as in claim 1 wherein said marking means includes plural inwardly-recessed surfaces and each said locating portion projects outwardly from said seam and is accepted within a respective one of said inwardly-recessed surfaces, wherein said means defining locating portions prevents lateral slippage of said seam relative said peripheral edge of said cushion member by virtue of said registry between said projecting locating portions and said inwardly recessed surfaces.

3. The vehicle seat as recited in claim 1, wherein said cushion member is formed of a foam material and wherein said top portion of said cover member includes means defining patterns.

4. The vehicle seat as recited in claim 1, wherein said cushion member has a surface of a concavo-convex configuration and said seam of said cover member is formed by sewing together plural cloth pieces so as to closely follow the concavo-convex surface of said cushion member.

* * * * *